US008248256B1

(12) United States Patent
Gerardi et al.

(10) Patent No.: US 8,248,256 B1
(45) Date of Patent: Aug. 21, 2012

(54) NON-CONTACT FLOOD AND MOISTURE DETECTOR

(76) Inventors: Joseph J Gerardi, Dryden, NY (US); Thomas Banas, Candor, NY (US)

( * ) Notice: Subject to any disclaimer, the term of this patent is extended or adjusted under 35 U.S.C. 154(b) by 363 days.

(21) Appl. No.: 12/435,337

(22) Filed: May 4, 2009

Related U.S. Application Data

(60) Provisional application No. 61/050,412, filed on May 5, 2008.

(51) Int. Cl.
*G08B 21/00* (2006.01)

(52) U.S. Cl. ..... 340/619; 340/604; 340/605; 340/616; 340/618

(58) Field of Classification Search ..... 340/604, 340/605, 619, 616, 618; 250/227.14; 73/307, 73/1.31, 1.73
See application file for complete search history.

(56) References Cited

U.S. PATENT DOCUMENTS

| | | | | |
|---|---|---|---|---|
| 4,266,195 | A | 5/1981 | Keefner | |
| 4,690,553 | A * | 9/1987 | Fukamizu et al. | 356/51 |
| 5,652,655 | A | 7/1997 | Uno | |
| 6,040,916 | A | 3/2000 | Griesinger | |
| 6,049,387 | A | 4/2000 | Griesinger | |
| 6,079,433 | A * | 6/2000 | Saarem | 137/1 |
| 6,683,535 | B1 | 1/2004 | Utke | |
| 7,164,110 | B2 | 1/2007 | Pitigoi-Aron | |
| 2005/0167593 | A1 * | 8/2005 | Forsyth | 250/339.11 |
| 2007/0001864 | A1 | 1/2007 | Gammon | |

* cited by examiner

*Primary Examiner* — Jennifer Mehmood
*Assistant Examiner* — Hongmin Fan

(57) ABSTRACT

A non-contact flood and moisture detector for detecting water on remote surface includes a source of IR radiation directed towards the remote surface and projecting a field of illumination on the remote surface, and a receiver of IR radiation directed towards the remote surface, and collecting the IR radiation from a field of view on the remote surface, with the field of illumination and the field of view at least partially overlapping. A portion of the IR radiation is backscattered and received by the receiver and a portion of the IR radiation is specularly reflected and not received by the receiver. An electronic circuit synchronized with the source and the receiver compares the IR radiation measured by the receiver to a dry baseline condition level where a decrease in the backscattered IR radiation measured by the receiver indicates the presence of water.

16 Claims, 9 Drawing Sheets

NON-CONTACT FLOOD AND MOISTURE DETECTOR

The present application claims the benefit of the U.S. Provisional Application No. 61/050,412, Non-contact Flood and Moisture Detector, filed on May 5, 2008.

FIELD OF THE INVENTION

The present invention relates to the devices and methods of remote detection of water and moisture, more particularly to remote optical non-contact detectors and detecting methods to detect flood and moisture damage to structures and property.

BACKGROUND

Flood and water damage occurs in homes and businesses due to failed water lines, clogged drains and failed appliances. Water damage can also occur from rising water levels that occur from unexpected rains and flash flooding. Most common damage occurs when the water or flooding happens unsupervised, i.e. when no person is available to take quick action to stop the source of the flooding. Water damage occurs worldwide and is one of the most costly repairs to the owner.

Water damage could be significantly reduced by deploying sensors that could survey unmonitored areas that may be prone to flood or water accumulation, or general areas (such as kitchens, restrooms, and laundry rooms) that have pressurized water lines and appliances. These sensors could be linked to security monitoring centers, local warning signs, or transmitted directly to central security monitoring agency.

Known sensors and detectors solutions involve the placement of a resistive, capacitive, or contact element on the floor to measure the presence of water by detecting changes in electrical current as the water covers the sensor. While these approaches are viable and have been implemented in the field, limitations exist. If the flooding water does not come into contact with the detector, or the detector is not sufficiently covered by water, of at least 1/16th inch depth, the floor sensor will fail to detect the water or flood condition. Also if the water flows around the sensor it also will fail to detect flooding. Use of a water containment barrier may be required to channel the water to the sensor element. Further, contact elements can get contaminated and provide false positives or fail to detect flooding. Finally, the cost of contact sensors remains high.

A number of sensors for timely detecting flood and moisture on the floor of a dwelling or other structure and for eliminating the sources of the flood and minimizing the damage resulting from the flooding are known. For example, U.S. Pat. No. 6,683,535, entitled WATER DETECTION SYSTEM AND METHOD, by G. H. Utke; U.S. Pat. No. 4,266,195, entitled WATER DETECTOR, by U. F. Keefner; and US Patent Application No. 20070001864, entitled WATER DETECTOR PROBE, by H. Gammon all describe various sensors and probes to detect moisture, typically by the contact or resistance measurement method.

Known sensors and detectors such as these referenced above, including the U.S. Pat. No. 6,683,535, teach detection of water utilizing continuity sensor placed on a surface. The water detection system includes an alarm relay and a water sensor. The water sensor includes a solid state switching and amplifying circuit for detecting low levels of current flow and amplifying the signal to activate the alarm relay. In some cases, the water detection system further includes an alarm panel, including visual and audible alarms activated by the alarm relay. In some cases, the water detection system includes multiple water sensors for providing zone protection. Furthermore, known water detection sensors and devices are having active elements that need to be physically placed or co-located on a lower surface or a floor. This requires complicated and costly installation procedures and wiring that must be run underneath of flooring materials or along the wall. Such detectors are also noticeable and intrusive, and must be located out of the beaten path so that they are not damaged by normal traffic and activities.

Further, some known sensors are utilizing hanging probes or surface electrodes that are in contact with or directly attached to the surface being monitored. The sensor must be carefully located to provide representative measurements of the surface under all environmental conditions and requires that the surface be cut for installation of the sensor as well as the cabling. Changes in the flooring or installation of a new flooring may render such sensors inoperational or require sensors reinstallation.

There is a need to develop an unobtrusive, easy to install, non-contact, and low cost detector which is capable to reliably and remotely detect flooding and moisture on the floor of a building, dwelling, house, or similar structure. Furthermore, there is a need in a water detector that has wide area sensitivity without the need to construct water containment barriers or channeling devices.

BRIEF DESCRIPTION OF THE INVENTION

Briefly, a non-contact flood and moisture detector for detecting water on a remote surface includes a source of IR radiation directed towards the remote surface and emitting IR radiation towards a field of illumination on the remote surface, and a receiver of IR radiation directed towards the remote surface, and collecting the IR radiation from a field of view on the remote surface, with the field of illumination and the field of view at least partially overlapping. A first portion of the IR radiation emitted by the source is backscattered from the remote surface and received by the receiver and a second portion of the IR radiation emitted by the source is specularly reflected from the remote surface and is not received by the receiver. An electronic circuit interconnected with the source and the receiver is adapted to compare the IR radiation measured by the receiver to a baseline dry conditions level of the IR radiation and a decrease in the IR radiation measured by the receiver indicates presence of water.

According to an embodiment of the present invention, a method for detecting water on a remote surface includes directing a source of IR radiation towards the remote surface and emitting an IR field of illumination on the remote surface, with a portion of the IR radiation backscattering off the remote surface, and a portion of the IR radiation specularly reflecting off the remote surface; directing a receiver of IR radiation towards the remote surface, and measuring IR radiation levels from a field of view on the remote surface; positioning the receiver and the source resulting in the field of illumination and the field of view at least partially overlapping and resulting in substantially no specularly reflected IR radiation measured by the receiver; and comparing the IR radiation levels to a baseline dry conditions and detecting water on the remote surface from a decrease in IR radiation levels.

BRIEF DESCRIPTION OF THE DRAWINGS

In the drawings, the like elements and components will bear the same designations and numbering throughout the Figures.

DETAILED DESCRIPTION

Figure 1:
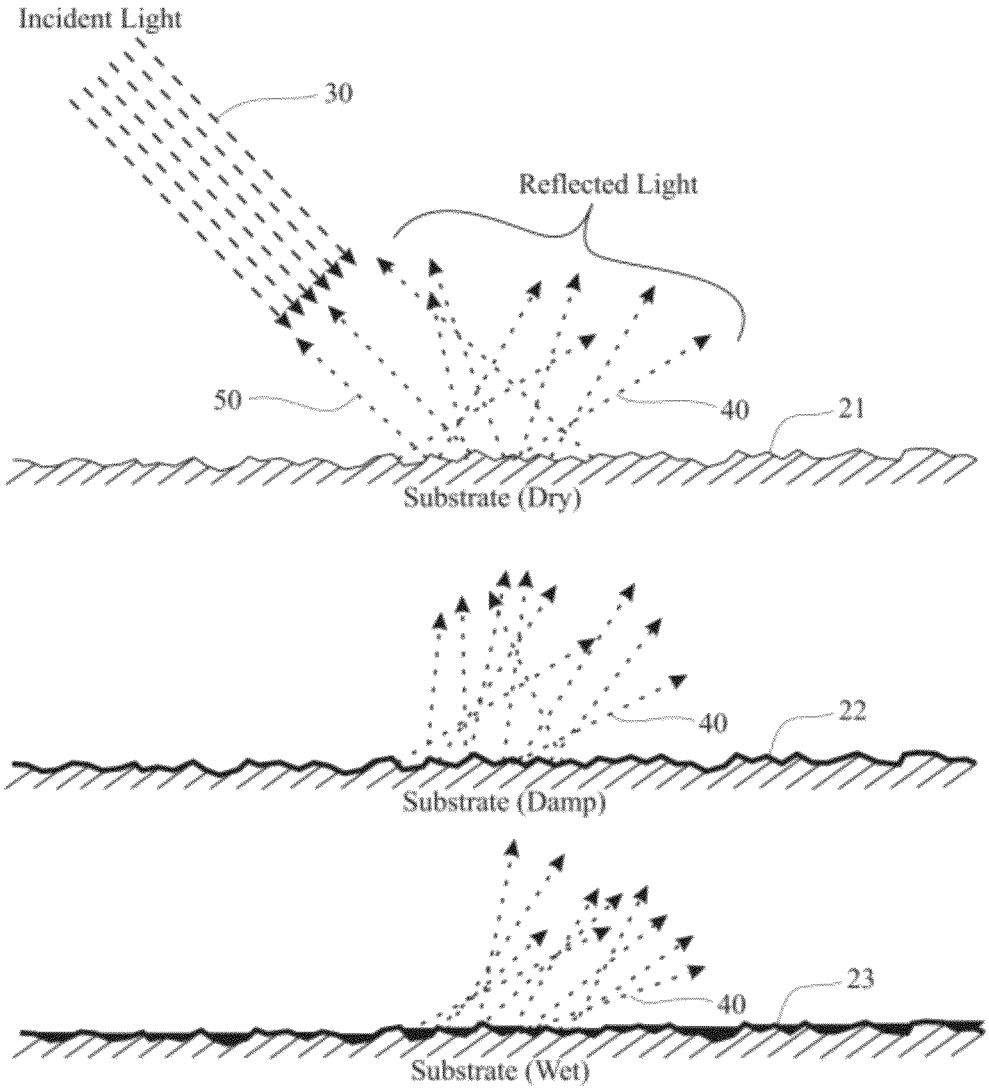
FIG. 1 is a schematic view of a surface illuminated with an IR light source with a specular reflection of the main beam away from the receiver at one angle and a secondary non-specular reflection component that is scattered back to the receiver at a second angle based on the surface texture and amount of water contaminant.

According to the present invention, the optical remote detector alleviates problems of the prior art by being remotely mounted on a wall or high ceiling. By using a beam of light to monitor the floor or other remote surface for presence of wetness or layers of water, the surface of the floor remains clear of installation wiring and other intrusive elements. This provides for the measurements of water on a surface without intruding on the surface being monitored, improving life of the detector.

A remote water detector according to the present invention has significant advantages over the current water detection sensors. The detector can be attached to existing walls and ceilings above, sideways, or below the surface of interest being monitored. When mounted well above the ground or floor surface, the detector can monitor larger areas. In addition, the remote detector can use the existing power and communications infrastructure available in homes thereby reducing the installation cost. Finally, detectors installed apart from the remote surface and especially above the surface are greatly isolated from surface contaminants and wear.

It is an object of the invention to provide a means of remotely detecting water and moisture on a surface when viewed from a distant location by an optical detector.

It is another object of the invention to communicate with a central controller or security system to notify individuals or emergency personnel of the hazard.

It is another object of the invention to monitor slippery conditions caused by water accumulation.

It is another objective of the invention to monitor flooding conditions caused by failed pipes or water lines.

It is another objective of this invention to monitor a plurality of surface materials with different roughness and emissivity It is another objective of this invention to automatically calibrate the receiver gain from a variety of ceiling heights It is another objective of this invention to notify the user if the unit performance is degraded due to the accumulation or dirt or grime on the optical assembly.

Other objectives will be clear from the following description of the present invention.

According to an embodiment of the present invention, a flood detector sends and receives optical signals, preferably infrared (IR) radiation from a remote location to detect water, moisture, or wetness on a surface. The surface of interest is illuminated with infrared radiation in distinct IR spectral bands. Backscatter reflections off of the surface texture are used as the receive signal and changes in the signal strength are used to determine the presence of contaminants on the surface, such as water and other liquids, which interfere with the dry baseline backscatter based on the IR absorption characteristics of the surface.

In one embodiment, the alarm relay is configured to provide notifications and or shut down the devices or systems causing the presence of water on the floor of the structure, such as to shut down the incoming water valves. A method for implementation of the water detection system is also provided.

While electromagnetic radiation in visible spectrum can be used, preferred embodiments of the present invention utilize infrared (IR) radiation sources or LED emitters and receivers. Sensor or receiver operating in visible domain will be more affected by ambient light and will be limited to detecting only standing water, but not as much a wet or damp surface. In addition there is a visible spot on the remote surface which might be distracting. Advantageously, IR receivers are less subject to such interferences. Furthermore, laser-based visible or IR sources have disadvantage of safety risk especially if a user or a person looks into the laser source for an extended period of time.

Highly focused light sources such as lasers have the disadvantage of potential interferences with the beam when a person or a pet or another moving object passes under the source or between the remote surface and source and or receiver and interferes with the measurement. Under some conditions this can result in a false positive alarm. A wider range of detection in the embodiment of the present invention results in more tolerance to such interferences and decreased amount of false positive alarms. Yet another disadvantage of highly focused sources such as lasers in the detection of flooding is only possible in a narrow small field illuminated by the focused source. Advantageously, embodiments of the present invention employ sources and receivers that illuminate and collect data from larger areas, or fields of illumination and fields of view, thus improving response time and reliability of detection of flood or moisture over larger surface areas.

In the event a water or flood event is detected, the detector outputs a signal to an audible alarm, a control panel input, electronic mail, or to a modem with a cellular phone text or recorded message transmission capability. In another embodiment, a water control valve installed on the building main water line can be automatically activated on a water detection and disable the flow of water into the facility.

In yet another embodiment, the water and flood detector can be installed in areas where a slippery surface constitutes a safety hazard. Locations such as bathrooms, kitchens, or stairs can be monitored for slippery conditions and illuminate a warning sign when detection of liquids, or frozen fluids on a surface has occurred.

In one embodiment the detector is monitoring the presence of moisture, liquids, or flood on substantially horizontal floors. In another embodiment the detector is monitoring the presence of moisture or liquids on on-horizontal, inclined, or vertical surfaces inside or outside of structures, such surfaces including walls. In yet another embodiment the detector is adapted to monitoring the presence of moisture on a ceiling.

Referring now to FIG. 1, a dry substrate 21, damp substrate 22, and wet or covered by moisture substrate 23 are illuminated with an incident IR light beam 30 send from a light source or an emitter (not shown). The IR light 30 is partially reflected from the substrate 21, 22, 23 at a plurality of angles which depend on the conditions of the surface of the substrate and partially absorbed by the substrate and any water present on the substrate.

The IR light beam 30 forms specular reflection light beams 40 and non-specular back scattered light beams 50 which are scattered back in the direction towards the incident IR light beam 30. The ratio between back scattered light 50 and reflected light 40 is based on the surface texture, type, and roughness, the amount of water contaminant, wavelength, and the amount of absorption of the IR light beam 30 by the present moisture. The inventors have surprisingly discovered that the ratio between backscattered light 50 and specularly reflected light 40 is strongly affected by the conditions of the surface, with dry substrate 21 surface having largest amount of backscattered light 50, and damp surface 21, and wet or flooded surface 23 having increased amounts of absorbed light and reflected light 40. In the near IR wavelengths, the backscattered light 50 is effected by a film or layer of fluid on the surface. This is schematically illustrated in FIG. 1 by showing progressively more specular reflected light 40 and less backscattered light 50 as the amount of moisture or dampness increases, on damp and wet substrates. The decrease in backscattered light is also a result of increased absorption of the incident IR light beam 30 by moisture present on the substrates 22 and 23, with more moisture resulting in more absorption and less backscatter.

Figure 2:
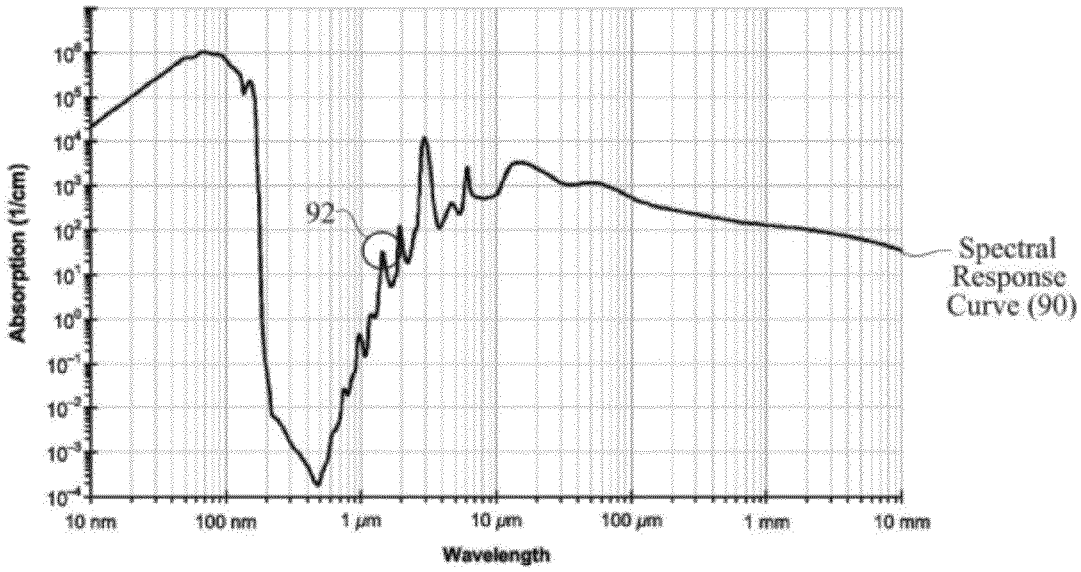
FIG. 2 is a plot of the IR light absorption in water as a function of wavelength, with the spectral response curve seen to drop in the visible and near infrared regions.

Referring now to FIG. 2, relative light absorption in water is shown as a function of wavelength. The spectral response curve 90 for water absorption is shown to be relatively high in the Ultraviolet and Mid Infrared regions. Due to the atmospheric absorption by airborne water (in the form of humidity) of incident solar radiation, very little natural radiation reaches the surface of the earth at these wavelengths. Therefore, a light source is needed at these wavelengths to illuminate a surface to remotely detect the presence of water or moisture in a target area. Though absorption is strongest in the UV and Mid IR regions, the inventors have discovered that water or moisture on a surface is also well absorbed at a peak in the near IR region of the spectrum where low cost optical components are becoming readily available, more particularly in the 1500 nm region 92. In accordance with an embodiment of the present invention, a low cost IR light source or emitter of IR light with a wavelength 1550 nm is used to illuminate a remote surface and detect the presence of water or moisture by measured absorption of IR light.

Figure 3:
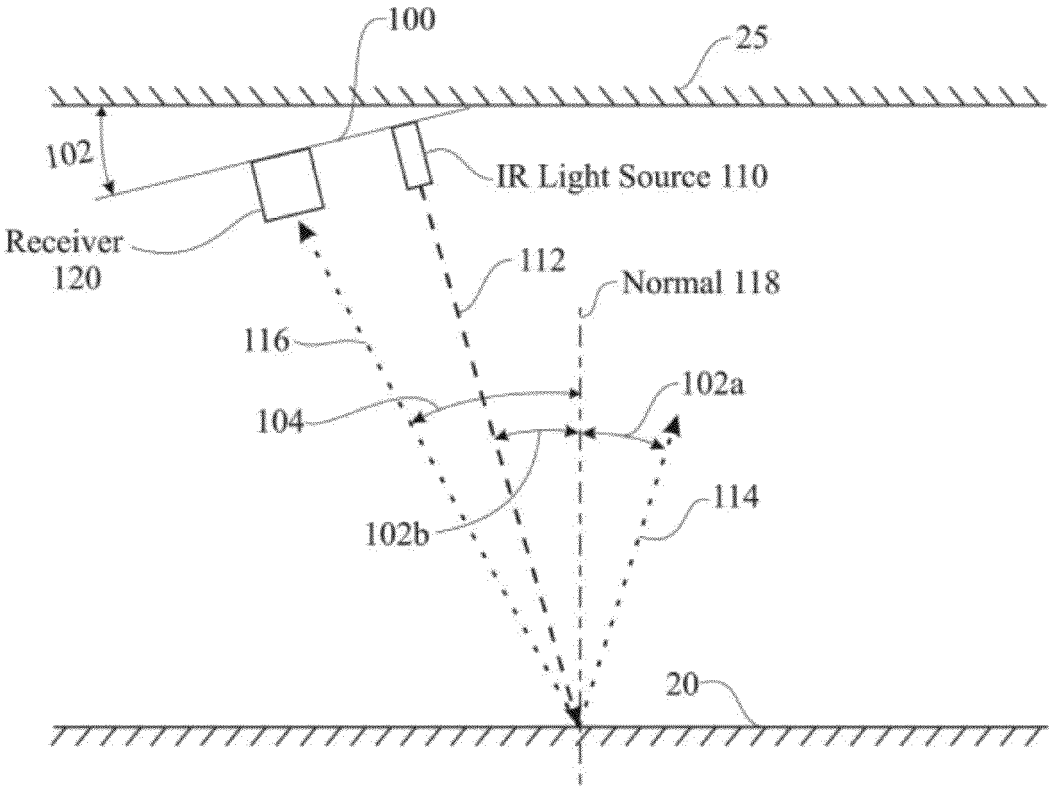
FIG. 3 is a schematic view of an embodiment of an optical remote detector assembly consisting of IR light source and receiver or photo detector, showing emitted beam path, back-scatter beam path, and specular reflected beam path.

Referring now to FIG. 3, an embodiment of a remote optical flood detector 100 is shown. Detector 100 includes an optical emitter or IR source 110, such as an IR LED, and a photo detector or receiver 120, mounted on surface 25 under mounting angle 102. Emitted beam 112 from source 110 after interacting with remote surface 20 is reflected from remote surface 20 as a specularly reflected beam 114 and a backscattered beam 116 which reaches receiver 120. The angle between normal perpendicular 118 to remote surface 20 and emitted beam 112 is shown as 102*b* and the angle between normal perpendicular 118 and specularly reflected beam 114 is shown as 102*a*, with the angles 102, 102*a*, and 102*b* being equal. The angle between normal perpendicular 118 and backscattered beam 116 which reaches receiver 120 is shown as 104.

Remote surface 20 can be dry, damp, wet, or covered by standing water. In one embodiment, remote surface 20 is the floor, and mounting surface 25 is a ceiling. In other embodiments remote surface 20 is a wall or ceiling, and mounting surface 25 is a ceiling or a wall.

IR source 110 can be of any type known to these skilled in the art. In one embodiment, the inventors have surprisingly discovered that a low cost low power LED transmitter known as a super luminescent LED provides enough illumination for operation of flood detector 100 the due to its high intensity output. IR LED of the power output from about 0.1 mW to about 100 mW can be utilized as IR source 110, depending on distance from mounting surface 25 to remote surface 20, type of remote surface 20; and level of light in the area; in one embodiment the IR source 110 is IR LED having 1 mW, or 5 mW, or 10 mW output. In one embodiment, IR source 110 emits light within the wavelengths from about 1400 to about 1550 nm.

Receiver 120 can be of any type known to these skilled in the art. In one embodiment receiver 120 is a photo detector operating in the same range of wavelengths as IR source 110. In one embodiment receiver 120 is a photo detector operating in range of wavelengths from about 1400 to about 1550 nm. Furthermore, the inventors have surprisingly discovered that the same type of low cost IR LED emitter that is used to generate the IR source 110 can be utilized as the receiver 120 operating with sufficient sensitivity to detect water on remote surface 20.

In operation of the detector 100, IR source 110 emits light beam 112 towards remote surface 20, light beam 112 is partially absorbed by remote surface 20, partially specularly reflected as beam 114 and partially backscattered and as beam 116 reaches receiver 120. The inventors have discovered that increased dampness of remote surface 20 and also presence of standing water on remote surface 20 results in more absorption and more specular reflection of light beam 112 so that less backscattered beam 116 reaches receiver 120. The level of signal detected by receiver 120 is then used to indicate presence of moisture or even standing water on remote surface 20.

In a preferred embodiment of the present invention, the angle 102*b* between normal perpendicular 118 to remote surface 20 and emitted beam 112 is more than 5 degrees which prevents the receiver 120 being blinded by specular reflection beam 114. Accordingly, mounting angle 102 is preferably more than 5 degrees.

Remote surface 20 can have any degree of specularity with least amount from a rough surface to most specularity from a smooth or standing water covered surface. When the surface is both dry and flat with a nominal texture, backscattered beam 116 which reaches receiver 120 is of sufficient strength to register as health dry voltage level.

Figure 4:
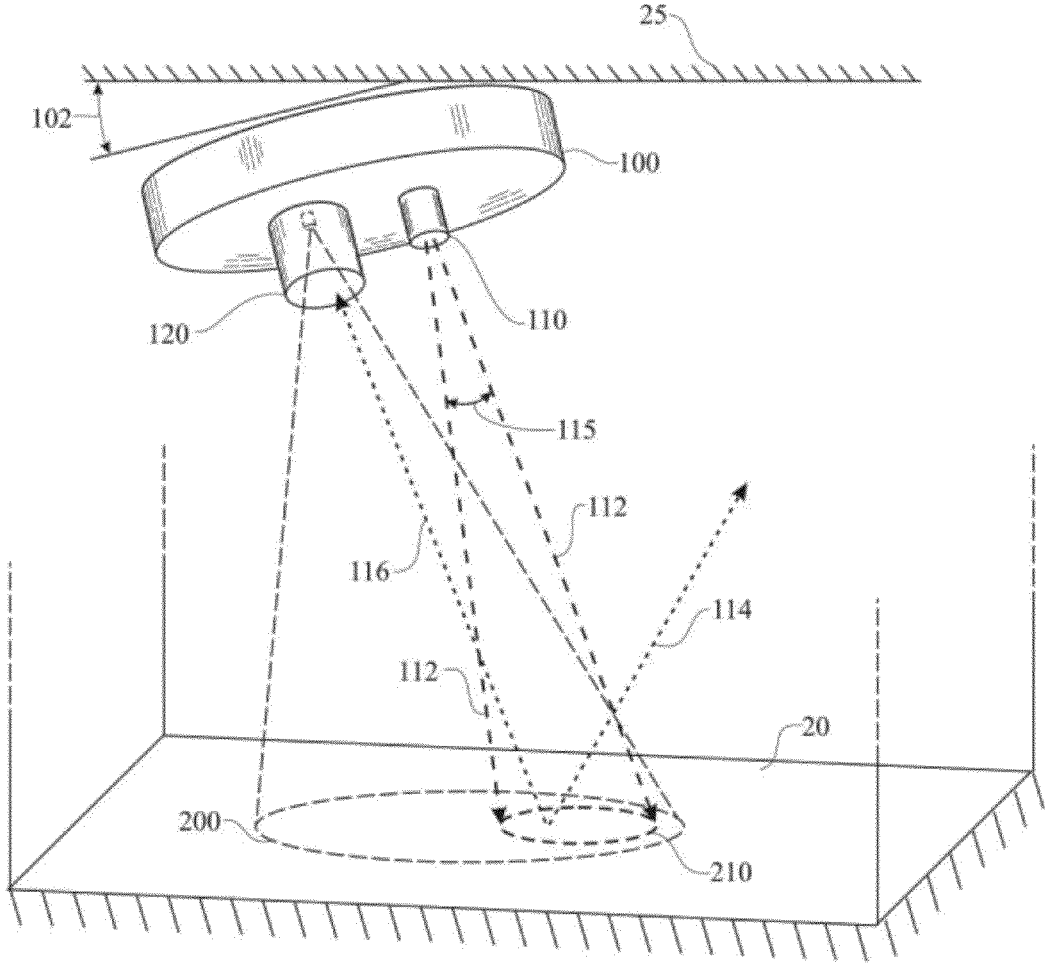
FIG. 4 is a schematic view of ceiling-mounted optical assembly showing an IR LED or laser emitter and photo-detector receiver with optical return signal due to backscatter from a dry textured surface.

Referring now to FIG. 4, an embodiment of flood detector 100 is schematically shown in operation in three-dimensional view, with source 110 emitting light towards remote surface 20, said light being characterized by beam divergence 115 and forming area of illumination 210 on remote surface 20. Receiver 120 is directed towards remote surface 20 and collects backscattered light from receiver field of view 200 corresponding to the area on remote surface 20 that is visible to receiver 120. Specular reflection beam 114 and backscattered beam 116 reaching receiver 120 are also shown.

Light emitted from source 110 interacts with remote surface 20 in the area of illumination 210, with some light being absorbed by water if it is present on said remote surface 20. Emitted beam 112 from source 110 is also reflected by water on remote surface 20 as specularly reflected beam 114, so that greatly reduced signal strength is returned to receiver 120 as backscattered beam 116.

According to an embodiment of the present invention, source 110 is positioned to project the field of illumination 210; and receiver 120 positioned to receive light from the field of view 200, field of illumination 210 and field of view 200 at least partially overlapping. In one embodiment the field of illumination 210 is smaller than the field of view 200. In another embodiment the field of illumination 210 is substantially equal to the field of view 200. In yet another embodiment, the field of illumination 210 is larger than the field of view 200. In all embodiments, there is a full overlap or at least some overlap of the field of illumination 210 and the field of view 200.

In all embodiment of the present invention, alignment of source 110 and receiver 120 is adapted to avoid direct specular reflection of emitted beam 112 from remote surface 20 directly into receiver 120 as specular reflected beam 114 and to only allow that receiver 120 receives backscattered light beam 116. To ensure this, in embodiments shown in FIGS. 3 and 4, detector 100 is installed on mounting surface 25 at a mounting angle 102. In this embodiment, source 110 and receiver 120 are aligned and directed towards remote surface 20 at the same angle which is non-perpendicular, i.e. at an angle 102*b* which is more than 0 degrees from perpendicular to remote surface 20. In another embodiment, source 110 and receiver 120 are non-parallel and directed towards the floor at angles to avoid direct specular reflection of emitted beam 112 from remote surface 20 directly into receiver 120, while ensuring at least some overlap of the field of illumination 210 and the field of view 200.

In one embodiment, the directional angle 102*b* of source 110 and receiver 120 is about 5 degrees, or 10 degrees, or 15 degrees, or 25 degrees, or 45 degrees, wherein 0 degrees angle corresponds to the direction perpendicular to remote surface 20.

Figure 7:
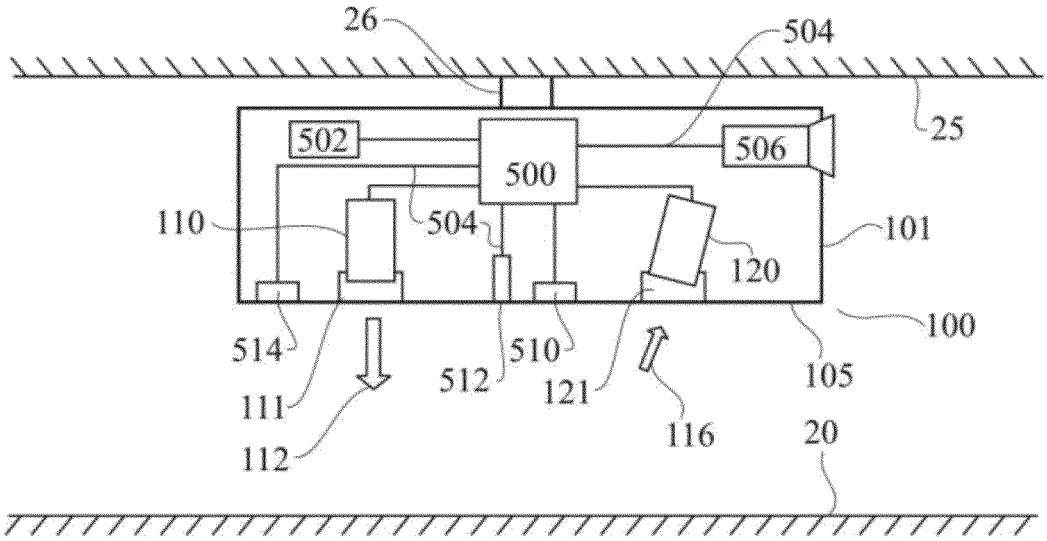
FIG. 7 is a schematic block diagram of an embodiment of the present invention.

In an embodiment shown in FIG. 7, detector 100 is installed parallel to mounting surface 25 and/or remote surface 20 with the mounting angle 102 (not shown in FIG. 7) equal to zero. In this embodiment, source 110 and receiver 120 are mounted within enclosure 101 of detector 100 with alignment towards remote surface 20 adapted to avoid direct specular reflection of emitted beam 112 from remote surface 20 directly into receiver 120 as specular reflected beam 114. To that end, source 110 and receiver 120 are mounted non parallel to each other within enclosure 101 of detector 100.

Figure 5:
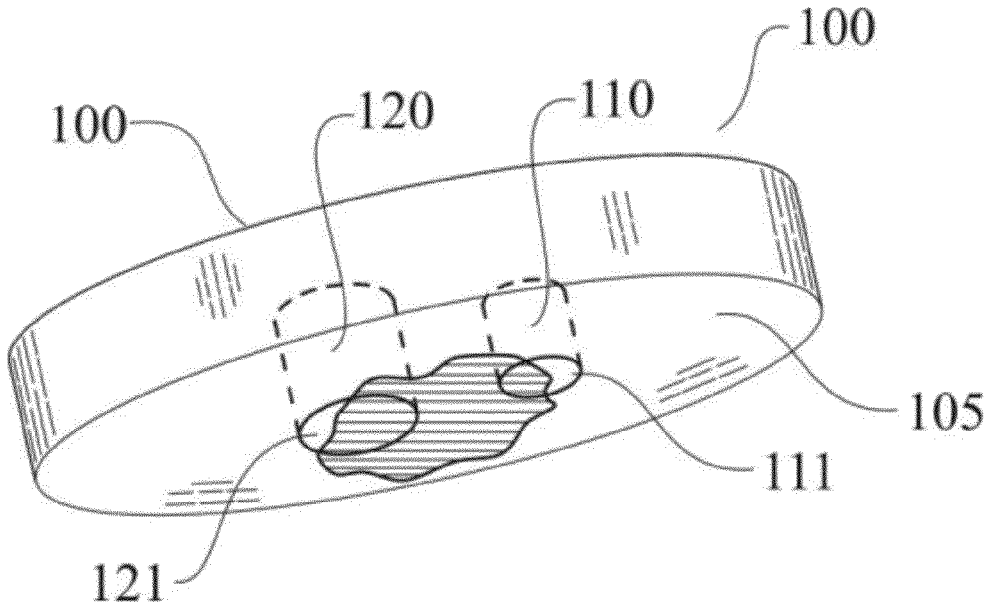
FIG. 5 is a schematic view of an embodiment of an optical remote detector assembly depicting an IR source, receiving photo detector, and enclosure optics that are all flush mounted for easy physical removal of surface debris that accumulates on the optic lenses over time.

Referring now to FIG. 5, an embodiment of flood detector 100 is shown with enclosure 101, enclosure face 105, source optics window or lens 111, and receiver optics window or lens 121 which are mounted flush on enclosure face 105 with source 110 and receiver 120 mounted within enclosure behind corresponding optics window or lens. These optional flush mounted source optics windows or lenses enable efficient transmission and reception of IR light while maintaining a flush surface with enclosure face 105, enabling optics windows or lenses 111 and 121 to be easily cleaned as needed or periodically. In one embodiment, IR light is transmitted through flush mounted lenses 121 and 111 to aid in self test of the optics as well as the cleaning of the device when dirty. Contamination 300 in a form of a deposited layer, dirt, dust, or grime, that may accumulate on the enclosure face 105 is schematically shown partially covering optics windows or lenses 111 and 121.

Figure 6:
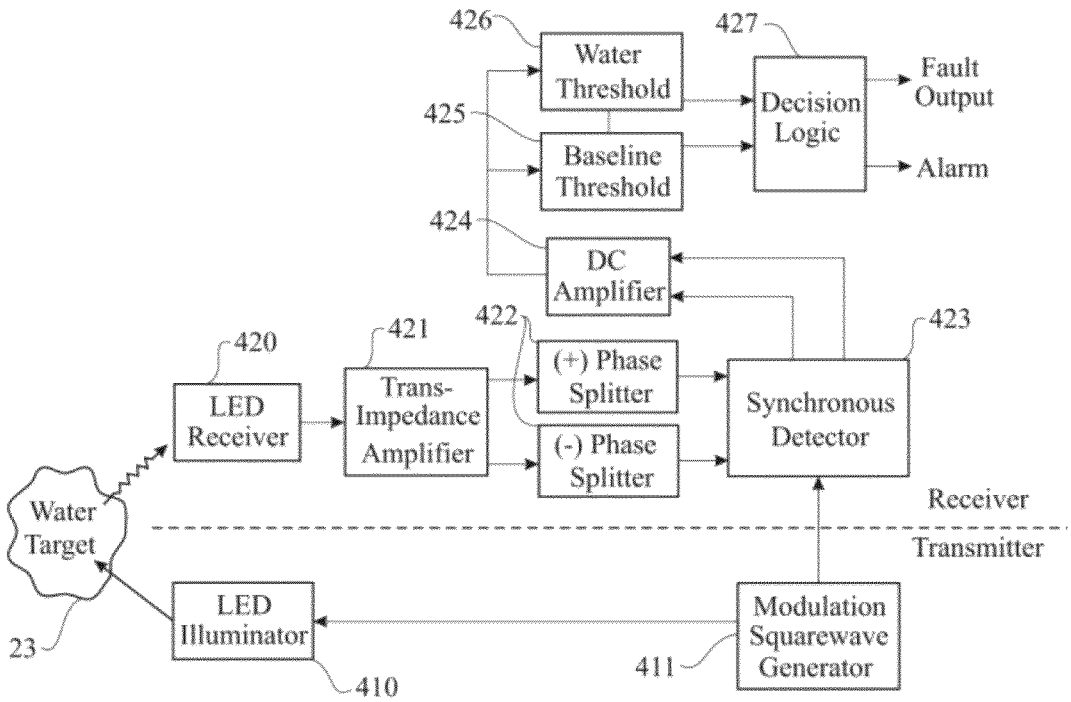
FIG. 6 is a schematic view of a functional block diagram of an embodiment of the flood detector circuit electronics depicting the transmitter, receiver, light modulator, receiver threshold voltage comparator and output alarm decision logic circuitry.

Referring now to FIG. 6, a schematic functional block diagram of an embodiment of flood detector 100 circuit electronics is shown, with functional electronic components interconnected to each other and including, LED source 410, LED receiver 420, modulation square wave generator 411 connected to LED source 410 and synchronous detector 423, transimpedance amplifier 241 connected to receiver 420 and two phase splitters 422, DC amplifier 424 connected to synchronous detector 423, receiver threshold voltage comparators 425 and 426 for baseline threshold and water threshold, and decision logic or output alarm logic circuitry 427 capable of receiving and analyzing data and outputting alarm signal and or fault output indicating faulty detector 100 needing service, new power supply, cleaning, or similar service.

The inventors have surprisingly discovered that use of a low cost IR LED 410 operating at wavelength of about 1550 nm results in unexpected sensitivity of detector 100. The IR LED 410 can be of any type as known to those skilled in the art.

Receiver 420 signal is synchronized with modulated transmission light emitted by source 410 using synchronous detection electronics 423 to improve the system Signal to Noise Ratio (SNR) in the presence of unwanted IR noise sources. In one embodiment, a square wave signal of frequency from about 10 Hz to about 10 kHz is used to modulate IR LED source 410 and also LED receiver 120. In one embodiment, frequency from about 100 Hz to about 2000 Hz is used.

The detector 100 contains electronic circuitry that contains logic and/or algorithms that read detector signal voltage levels and determine whether or not an alarm is to be initiated. In its most basic function, threshold voltage levels are manually set using a potentiometer or a software settable internal memory register. These threshold voltage levels are compared to the receiver 420 output voltage levels. If the receiver output is above the water threshold level, the output reads dry or normal. When water or moisture is present on remote surface 20, and the receiver 420 voltage level drops below that of the water detect threshold, then a voltage comparator recognizes this exceedance and sets a water detect alarm condition. In one embodiment, a loop continuously reads receiver 420 output voltages and sets an output based on decision logic programming.

One such decision logic 427 monitors the dry baseline condition over time. If detector 100 enclosure face 105 gets dirty over time, receiver 420 baseline signal will continue to drift down and will eventually result in a False Alarm condition, due to the reduced receiver 420 signal level caused by the dirty lens or window 121. In one embodiment, decision logic 427 is employed to monitor this slow drift in the dry baseline condition. When the baseline dry level shifts more than 50% of its dry calibration level, the decision logic 427 activates a flag or a blinking light to alert the user that the unit is dirty and not functioning properly. Once the unit is cleaned, decision logic is employed to re-calibrate the unit at the press of a button.

When the unit is installed, decision logic 427 is used to auto calibrate the unit for variable heights and variable surface texture and emissivity values. In another embodiment, Decision logic 427 is used to periodically check the function of the unit with a built-in-test mode and alerts the user when a failure mode is detected or the optical cover is dirty, indicating that the detector should be cleaned or re-calibrated.

Referring now to FIG. 7, flood detector 100 includes an enclosure 101 in which the components of the detector are mounted, including source 110, receiver 120, which are sending and receiving optical signals (shown schematically by arrows) towards remote surface 20 through optional lenses or optical windows 111 and 121, which are optionally mounted flush on enclosure face 105. Enclosure face 105 is positioned generally opposite and facing remotely remote surface 20. Flood detector 100 further includes mounted in enclosure 101 electronic circuit 500, power supply 502, with power supply 502 connected to electronic circuit 500 and electronic circuit connected to source 110 and receiver 120 with interconnects or conductors 504. In one embodiment, source 110, receiver 120, power supply 502, and electronic circuit 500 are all mounted on a single circuit board (not shown). Power supply 502 can be a battery, a rechargeable battery, a wired in external power line, or solar power based power supply or any other suitable power supply.

Alarm means 506 is interconnected to electronic circuit 500 and is mounted within enclosure 101 or partially or fully outside of enclosure 101. Alarm means 506 includes: audible alarm means such as sound siren produced by speakers or by electric buzzer; optical alarm means such as blinking light; electronic alarm communications system, such as wired or wireless signal transmitter notifying affected persons of flood conditions; electric signal effecting shutoff of the liquids which caused the flooding; other known alarm systems and devices, or combinations thereof.

An optional light indicator 510 of power supply failure or low power or dirty lens condition or other fault with the detector 100 is mounted on enclosure 101 on one of the surfaces of enclosure 101 visible to an operator or user, for example on enclosure face 105.

A visible laser pointer is optionally co-located with detector 100 to aid in the location of field of illumination 210 and field of view 200. An optional pointer 512 adapted to show the location of monitored area (field of view and/or field of illumination) by a permanent or intermittent or on demand visible light spot is mounted on the enclosure face 105. In a preferred embodiment pointer 512 is a laser pointer temporarily actuated by the installer of flood detector 100.

An electric switch 514 is optionally located on enclosure 101 to enable installer or operator or user to initiate a test or calibration of detector 100.

An ambient light sensor (not shown) capable of detecting ambient light in the vicinity of detector 100 but not receiving backscattered light beam 116 is optionally installed in enclosure 101, preferably aligned so as to not to face field of illumination 210, and communicates with decision logic 427 to improve sensitivity of detector 100 and decrease false positives.

Enclosure 101 is mounted directly on the mounting surface 25 such as ceiling or with an optional mount 26 enabling alignment of detector 100.

Optional lenses or optical windows 111 and 121 can further incorporate IR filter elements (not shown) to increase sensitivity and signal to noise ratio of detector 100. An optional mechanical IR notch filter cover on optional lens or optical window 121 is optionally used to mitigate unwanted IR sun light that can saturate the IR receiver 120 circuitry.

In one embodiment, flood detector 100 includes a plurality of sources 110, some of which can be installed within same enclosure 101 or in a separate enclosure (not shown).

Figure 8:
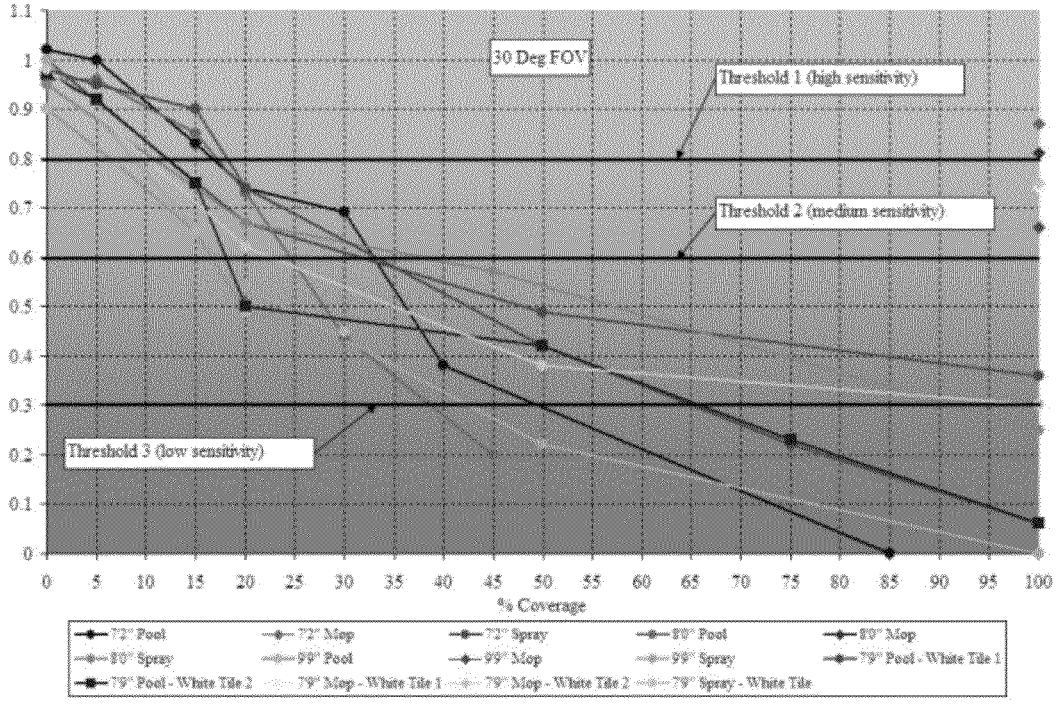
FIG. 8 is a data chart depicting receiver threshold voltage levels for different thicknesses of a fluid on an industrial tile surface as a function of increasing amounts of wetted surface area.

Referring now to FIG. 8, a data chart shows the data obtained with an embodiment of the present invention with receiver threshold voltage levels for different types of fluids on an industrial tile surfaces as a function of increasing amounts or area of coverage of the fluid. As it can be seen from the chart, there is a substantial signal (voltage) change as a function of the size of the affected area and quantity of water present (from wet surfaces to standing water). Increase in the percentage of the area of field of view 200 affected by water and increase in the amount of water both resulted in substantial signal (voltage) change shown of the plot as a decrease in signal is observed with increased wetted surface area.

Figure 9:
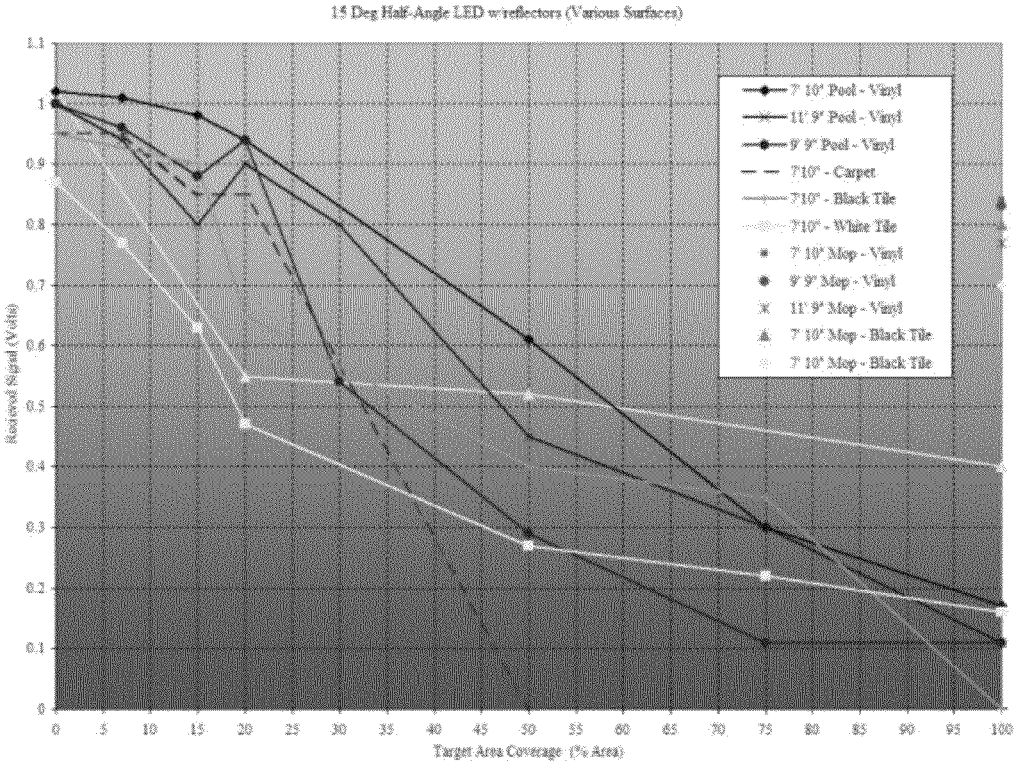
FIG. 9 is a data chart depicting receiver voltage amplitude levels for different surface materials with various textures and emissivity on a remote surface as a function of increasing amounts of wetted surface area.

Referring now to FIG. 9 a data chart shows the data obtained with an embodiment of the present invention, with receiver voltage amplitude for different surface materials with various textures and emissivity on a dry surface as a function of increasing amounts of wetted surface area with conditions ranging from dry to moist to standing water. The receiver output voltage is shown to drop (or attenuate) with increasing height of the water layer or with larger size of the water affected area. Materials included vinyl; carpet, and tile.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A non-contact flood and moisture detector for detecting water on a remote surface, comprising:

a source of IR radiation directed towards the remote surface and emitting an IR radiation and projecting a field of illumination on the remote surface;

a receiver of IR radiation directed towards the remote surface, and collecting the IR radiation from a field of view of the remote surface;

a non-contact flood and moisture detector for detecting water on a remote surface, comprising: a source;

wherein a second portion of the IR radiation emitted by the source is specularly reflected from the remote surface and received by the receiver;

wherein a first portion of the IR radiation emitted by the source is backscattered from the remote surface and received by the receiver;

wherein a second portion of the IR radiation emitted by the source is specularly reflected from the remote surface and is not received by the receiver;

An electronic circuit connected with the source and the receiver and adapted to compare the IR radiation received by the receiver by the receiver to a baseline dry condition level of the IR radiation;

wherein a decrease in the IR radiation received by the receiver indicates presence of water;

wherein the electronic circuit comprises an electronic logic circuit adapted to perform a self-test and a self-calibration and notify a user of contamination with dirt or grime;

with the electronic logic circuit further adapted to automatically setting the receiver gain independent of an emissivity of the remote surface and of a distance between the remote surface and the non-contact flood and moisture detector.

2. The non-contact flood and moisture detector according to claim 1;

further comprising an alarm connected to the electronic circuit; WHEREIN the electronic circuit is activating the alarm in presence of water;

wherein the alarm is an audible alarm, a visible alarm, an electronic communication alarm, a wired alarm, a wireless alarm, or combination thereof.

3. The non-contact flood and moisture detector according to claim 2;

wherein the source comprises a Light Emitting Diode operating in range of wavelengths in the near infrared region from 1400 to 1550 nm.

4. The non-contact flood and moisture detector according to claim 3, that further comprising an IR filter adapted to fitter out unwanted light sources and unwanted reflections into the receiver.

5. The non-contact flood and moisture detector according to claim 4;

wherein the receiver is an IR LED or a photo-detector;

wherein the receiver is a synchronous detector; and wherein the source is a modulated LED synchronized with the receiver.

6. The non-contact flood and moisture detector according to claim 5;

wherein the source comprises a source IR LED emitter; and wherein the source IR LED emitter and the receiver IR LED emitter are physically the same IR LED emitter.

7. The non-contact flood and moisture detector according to claim 6;

further comprising a water detect threshold stored in the electronic logic circuit;

wherein the electronic logic circuit is adapted to compare the water detect threshold with a voltage output of the receiver and to trigger the alarm when the voltage output of the receiver decreases below the water detect threshold.

8. The non-contact flood and moisture detector according to claim 7;

further comprising an integrated visible laser pointer adapted for determining the field of view and the field of illumination on the remote surface.

9. The non-contact flood and moisture detector according to claim 8, further comprising a sensor adapted to detect ambient light conditions, wherein the electronic logic circuit is adapted to use ambient light conditions to improve accuracy of the non-contact flood and moisture detector.

10. The non-contact flood and moisture detector according to claim 9, wherein the source and the receiver are positioned avoiding direct specular reflection of the IR radiation emitted by the source into the receiver.

11. A method for detecting water on a remote surface, comprising the steps of:

directing a source of IR radiation towards the remote surface and emitting an IR radiation and projecting a field of illumination on the remote surface, with a portion of the IR radiation backscattering off the remote surface, and a portion of the IR radiation specularly reflecting off the remote surface;

directing a receiver of IR radiation towards the remote surface and measuring IR radiation levels from a field of view on the remote surface;

positing the receiver and the source resulting in the field of illumination and the field of view at least partially overlapping and resulting in substantially no specularly reflected IR radiation measured by the receiver;

comparing the IR radiation levels to a baseline dry condition and detecting water on the remote surface from decreased IR radiation levels;

performing a self-test and a self-calibration and notifying a user of contamination with dirt or grime;

automatically setting the receiver gain independent of an emissivity of the remote surface and of a distance between the remote surface and the non-contact flood and moisture detector, storing a water detect threshold in the electronic circuit;

comparing the water detect threshold with a voltage output of the receiver and triggering the alarm when the voltage output of the receiver decreases below the water detect threshold;

wherein the electronic circuit comprises an electronic logic circuit.

12. The method of claim 11, further comprising the steps of:

providing an alarm connected to the electronic circuit;

activating the alarm by the electronic circuit in presence of water;

wherein the alarm is an audible alarm, a visible alarm, an electronic communication alarm, a wired alarm, a wireless alarm, or a combination thereof.

13. The method of claim 12, further comprising the steps of:

filtering out unwanted light sources and unwanted reflections into the receiver with an IR filter, and operating the source as a Light Emitting Diode in range of wavelengths in the near infrared region from 1400 to 1550 nm.

14. The method of claim 13, further comprising the steps of:

operating the receiver as a synchronous IR LED or a photo-detector;

operating the source as modulated IR LED source synchronizing the source with the receiver.

15. The method of claim 14:

wherein the source comprises a source IR LED emitter;

wherein the receiver comprises a receiver IR LED emitter; and wherein the source IR LED emitter and the receiver IR LED emitter are physically the same IR LED emitter.

16. The method of claim 15, further comprising the steps of:

providing an integrated visible laser pointer, determining the field of view and the field of illumination on the remote surface using the integrated visible laser pointer, and positioning the source and the receiver avoiding direct specular reflection of the IR radiation emitted by the source into the receiver.

* * * * *